US008029091B2

(12) United States Patent
Kato

(10) Patent No.: US 8,029,091 B2
(45) Date of Patent: Oct. 4, 2011

(54) INK-JET RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 458 days.

(21) Appl. No.: 12/345,539

(22) Filed: Dec. 29, 2008

(65) Prior Publication Data

US 2009/0167801 A1 Jul. 2, 2009

(30) Foreign Application Priority Data

Dec. 27, 2007 (JP) ..... 2007-335623

(51) Int. Cl.
*B41J 29/393* (2006.01)
*B41J 2/165* (2006.01)

(52) U.S. Cl. ..... 347/23; 347/19

(58) Field of Classification Search ..... 347/19, 347/23

See application file for complete search history.

(56) References Cited

U.S. PATENT DOCUMENTS 5,296,876 A * 3/1994 Yamaguchi et al. ..... 347/23
5,428,379 A * 6/1995 Kaneko et al. ..... 347/23
6,352,331 B1 * 3/2002 Armijo et al. ..... 347/19

FOREIGN PATENT DOCUMENTS

JP 2006-187979 A 7/2006

* cited by examiner

*Primary Examiner* — Julian Huffman
(74) *Attorney, Agent, or Firm* — Baker Botts L.L.P.

(57) ABSTRACT

The present invention provides an inkjet recording apparatus includes an inkjet head, a conveyor, a printing controller, an image sensor, a blocking object determining unit, and a blocking object dealing unit. The inkjet head has an ejection surface in which plural ejection outlets ejecting ink are formed. The conveyor has a placing member on which a recording medium is placed and conveys the placing member to a position opposing the ejection surface. The printing controller causes the conveyor to convey the placing member to the opposing position and causes the inkjet head to eject the ink towards the opposing position. The image sensor captures an image of at least one of (i) a surface of the recording medium placed on the placing member, (ii) a surface of the placing member, and (iii) the ejection surface. The blocking object determining unit determines, based on the image captured by the image sensor, whether an object which blocks the flight of the ink exists between the ejection outlets and the opposing position so as to obstruct at least two neighboring ejection outlets among the ejection outlets. The blocking object dealing unit carries out a predetermined blocking object dealing operation when the blocking object determining unit determines that the object blocking the flight of the ink obstructs at least two neighboring ejection outlets among the ejection outlets.

14 Claims, 14 Drawing Sheets

INK-JET RECORDING APPARATUS

CROSS REFERENCE TO RELATED APPLICATION

The present application claims priority from Japanese Patent Application No. 2007-335623, which was filed on Dec. 27, 2007, the disclosure of which is herein incorporated by reference in its entirety.

BACKGROUND OF THE INVENTION

1. Field of the Invention

The present invention relates to an inkjet recording apparatus having ejection outlets ejecting ink.

2. Description of Related Art

In an ink inkjet recording apparatus having an inkjet head in which two or more ejection outlets are formed to eject ink therefrom, the ink ejected from the inkjet head to a recording medium may not be properly deposited on the medium. In this regard, a conventional approach is such that a chart for detecting the misfiring of ink is printed by each nozzle, and the chart is read out by a reading unit constituted by a line sensor and the like. Which nozzle is misfiring is determined by analyzing the read data.

Several reasons are conceivable why ink is not properly deposited on a recording medium. For example, ink is not properly ejected from the ejection outlets because there is something wrong in the inkjet head. Another example is that something obstructing the flight of ink adheres to the inkjet head. As such, to solve the problem of improper deposition of ink on a recording medium, it is necessary to take a suitable action corresponding to the cause of the problem. The aforesaid conventional approach, however, does not make it possible to determine what is a proper action, because determined according to the conventional approach is merely whether each nozzle is misfiring or not. For this reason, the conventional approach may not be sufficient to properly solve the problem of improper deposition of ink from the inkjet head to a recording medium.

SUMMARY OF THE INVENTION

It is an object of the present invention to provide an inkjet recording apparatus in which a condition where ink is not properly deposited on a recording medium is properly resolved with ease.

The present invention provides an inkjet recording apparatus comprising: an inkjet head having an ejection surface in which plural ejection outlets ejecting ink are formed; a conveyor which has a placing member on which a recording medium is placed and which conveys the placing member to a position opposing the ejection surface; a printing controller which causes the conveyor to convey the placing member to the opposing position and causes the inkjet head to eject the ink towards the opposing position; an image sensor which captures an image of (i) either a surface of the recording medium placed on the placing member or a surface of the placing member or (ii) the ejection surface; a blocking object determining unit which determines, based on the image captured by the image sensor, whether an object which blocks the flight of the ink exists between the ejection outlets and the opposing position so as to obstruct at least two neighboring ejection outlets among the ejection outlets; and a blocking object dealing unit which carries out a predetermined blocking object dealing operation when the blocking object determining unit determines that the object blocking the flight of the ink obstructs at least two neighboring ejection outlets among the ejection outlets.

According to the present invention, it is determined whether an object which blocks the flight of ink obstructs two or more ejection outlets. It is therefore possible to suitably perform a blocking object dealing operation which should be carried out when it is determined that such an object exists. For this reason the problem where ink is not properly deposited onto a recording medium can be suitably solved. The blocking object dealing operation is equivalent to various operations for recovering the normal state in which no blocking object exists. Examples of such operations include a removal operation of removing a blocking object, a notification operation of notifying the user of the existence of a blocking object, and a combination of these operations. The blocking object dealing operation is also equivalent to various operations contributing to the operations for recovering the normal state.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe preferred embodiments of the present invention with reference to figures.

First Embodiment

An inkjet printer of a first embodiment of the present invention receives image data from an external device or the like and forms on a media sheet P an image from the image data.

Figure 1:
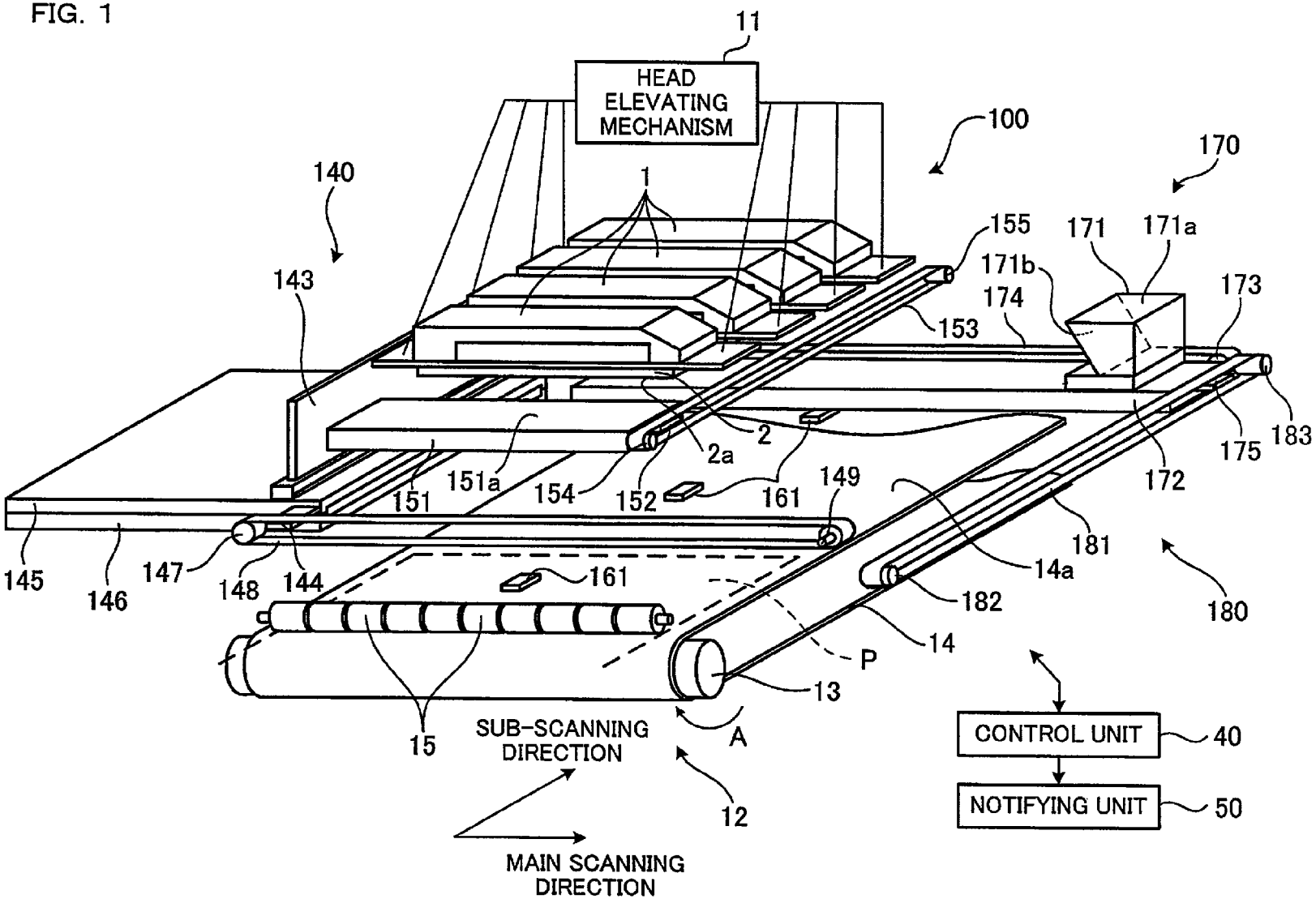
FIG. 1 is a perspective view which outlines an inkjet printer of a first embodiment of the present invention.

The inkjet printer 100 includes a control unit 40 as outlined in FIG. 1. The control unit 40 provides control of each part of the inkjet printer 100 and receives data from various sensors of the inkjet printer 100. The inkjet printer 100 is further provided with a notifying unit 50 which notifies the user of various types of information. The notifying unit 50 may be a display mounted on the chassis of the inkjet printer 100. The display has a screen which displays information regarding for example the printing status and error information concerning the operation of the inkjet printer 100.

The inkjet printer 100 is further provided with a sheet conveyance mechanism 12 by which media sheets P are conveyed. The sheet conveyance mechanism 12 includes nip rollers 15, conveyor rollers 13, and a conveyor belt 14. There is a pair of conveyance rollers 13 in the sheet conveyance mechanism 12, and FIG. 1 illustrates one of these two conveyor rollers 13. The other conveyor roller 13 is horizontally distanced from the conveyor roller 13 of FIG. 1 along the sub-scanning direction. These two conveyor rollers 13 are both long in the main scanning direction. One of the two conveyor rollers 13 is driven by an unillustrated drive unit and rotates in the A direction of FIG. 1, whereas the other conveyor roller 13 is supported in the inkjet printer 100 to be rotatable in the A direction.

It should be understood that in this specification, the sub-scanning direction is in parallel with the direction of conveying media sheets (that is, the direction toward the surface of FIG. 1) and the main scanning direction is orthogonal to the sub-scanning direction and in parallel with the horizontal surface (that is, the main scanning direction is the direction to the right in FIG. 1). It is also noted that the words such as "above" and "below" are used with reference to the orientations in FIG. 1 being described.

The conveyor belt 14 is an endless belt wrapping the two conveyor rollers 13. Among the two surfaces of the conveyor belt 14, the surface not in contact with the conveyor rollers 13 is a media contact surface 14*a* on which a media sheet P is placed. As the conveyor rollers 13 rotate, the conveyor belt 14 moves on the conveyor rollers 13 in the rotational direction of the conveyor rollers 13.

The sheet conveyance mechanism 12 is provided with two or more nip rollers 15 which are lined up along the main scanning direction. The nip rollers 15 are supported above the conveyor rollers 13 so as to be rotatable about the rotational axis extending along the main scanning direction. The nip rollers 15 are biased downward towards the media contact surface 14*a* of the conveyor belt 14 by an unillustrated biasing device.

The media sheets P are supplied from an unillustrated sheet feeding unit to the sheet conveyance mechanism 12. When one end of a media sheet P reaches the nip rollers 15, the media sheet P is sandwiched between the nip rollers 15 and the conveyor belt 14. As the conveyor belt 14 moves, the media sheet P sandwiched between the nip rollers 15 and the conveyor belt 14 moves in the sub-scanning direction, with the result that the media sheet P becomes closely in contact with and disposed on the media contact surface 14*a* of the conveyor belt 14. After passing through the nip rollers 15, the media sheet P is conveyed in the sub-scanning direction by the conveyor belt 14 while being closely in contact with the media contact surface of the conveyor belt 14.

The inkjet printer 100 is further provided with conveyance sensors 161 each of which detects the passing of a media sheet P conveyed by the sheet conveyance mechanism 12. The conveyance sensors 161 are disposed slightly above the media contact surface 14*a* of the conveyor belt 14 so as to be able to detect the media sheets P passing below. Also, the conveyance sensors 161 are disposed in the vicinity of the later-detailed regions which oppose the inkjet heads 1 in the vertical direction. In a plan view, each conveyance sensor 161 is disposed, for example, between the neighboring inkjet heads 1 in such a way as not to obstruct the flight of ink from the inkjet heads 1 to a media sheet P. As illustrated in FIG. 1, there are plural conveyance sensors 161 provided along the conveyance path on which the media sheets P are conveyed. A result of detection by each conveyance sensor 161 is sent to the control unit 40.

The inkjet printer 100 is further provided with four inkjet heads 1. To a large degree each inkjet head 1 is rectangular and long in the main scanning direction in a plan view. These four inkjet heads 1 are on the same horizontal plane and at the same position relative to the main scanning direction, and are provided at predetermined intervals in the sub-scanning direction. The lower part of each inkjet head 1 is a head main body 2 in which ink flow paths are formed. Further details of the head main body 2 are given below.

The under surface of the head main body 2, that is, the under surface of the inkjet head 1 is an ink ejection surface 2*a* on which ink ejection outlets are formed. The ink ejection surface 2*a* is a horizontal and planar surface facing the media contact surface 14*a* of the conveyor belt 14. Within the inkjet head 1 there are formed ink flow paths. One end of each ink flow path is connected to a nozzle in the ink ejection surface 2*a* and the other end of the ink flow path is connected to an ink supply opening (not illustrated) formed in the upper surface of the inkjet head 1. The ink supply opening is connected to an ink tank (not illustrated) which stores ink with a color corresponding to each inkjet head 1. In the meanwhile, on the media contact surface 14*a* of the conveyor belt 14, a media sheet P is conveyed to a region vertically opposing the inkjet head 1 by the sheet conveyance mechanism 12. An ink droplet ejected from the inkjet head 1 is deposited on the media sheet P which is conveyed to the region below the inkjet head 1 by the sheet conveyance mechanism 12, so that a dot is formed on the sheet.

The both ends of the inkjet head 1 are fixed to a head elevating mechanism 11. The head elevating mechanism 11 moves up and down the four inkjet heads 1 simultaneously so as to adjust the distance between the ink ejection surfaces 2*a* and the media contact surface 14*a* which is the upper surface of the conveyor belt 14. The head elevating mechanism 11 moves up and down the inkjet heads 1 so that the ink ejection surfaces 2*a* are horizontally aligned at the same level. As such, the inkjet heads 1 can be positioned so that the ink ejection surface 2*a* are at each of the later-detailed height levels H1 to H5.

Figure 2:
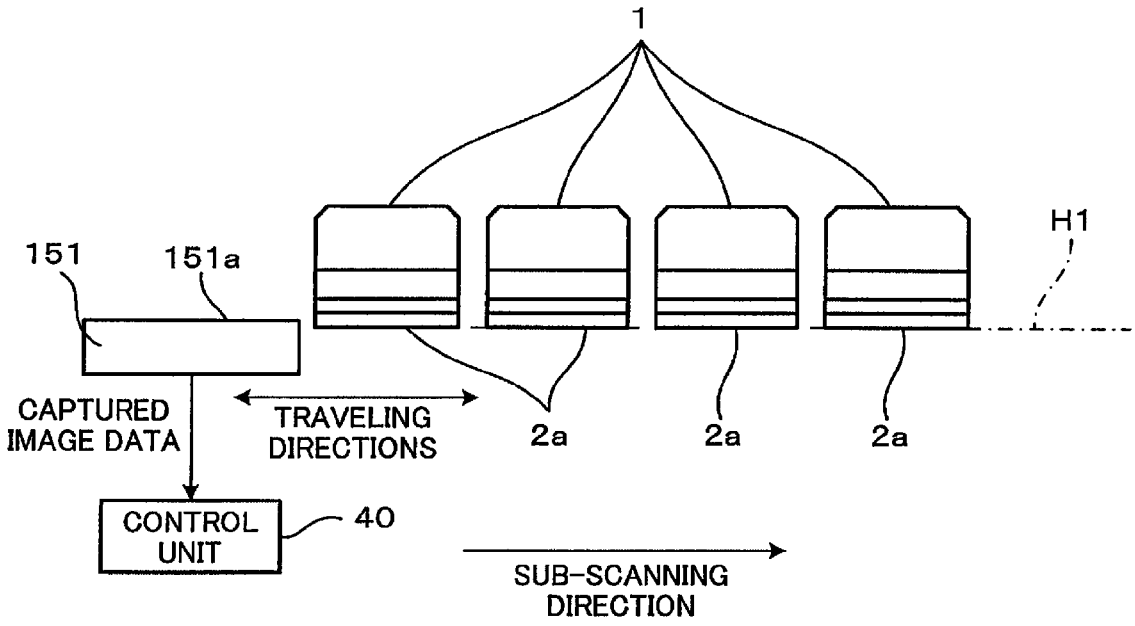
FIG. 2 is a profile around the inkjet heads and image sensor of FIG. 1.

As illustrated in FIGS. 1 and 2, the inkjet printer 100 is further provided with an image sensor 151 which captures an image of the ink ejection surface 2*a* of each inkjet head 1. When the image sensor 151 captures an image, as illustrated in FIG. 2, the head elevating mechanism 11 moves the inkjet heads 1 so that the ink ejection surfaces 2*a* are at the height level H1 which is slightly above the image sensor 151. This allows the image sensor 151 to pass below the inkjet heads 1. The upper surface of the image sensor 151 is a reader surface 151*a*. In the vertical direction, the reader surface 151*a* is slightly below the ink ejection surfaces 2*a*. The reader surface 151*a* is long in the main scanning direction, that is, the image sensor 151 is a line-type sensor. The capturing range of the image sensor 151, that is, the coverage of the reader surface 151*a* is identical with the printable range of the inkjet heads 1 in the main scanning direction.

The inkjet printer 100 is further provided with an image sensor moving mechanism which moves the image sensor 151 in the sub-scanning direction. As illustrated in FIG. 1, this image sensor moving mechanism includes a drive roller 154, a driven roller 155, and a drive belt 153. The drive roller 154 and driven roller 155 are horizontally distanced from each other in the sub-scanning direction. These rollers are supported so as to be rotatable about the respective rotational axes extending along the main scanning direction. The drive roller 154 is configured to rotate about the rotational axis by an unillustrated drive motor. The drive belt 153 wraps the drive roller 154 and driven roller 155. As the drive roller 154 rotates, the drive belt 153 moves around the rollers. In the meanwhile, the image sensor 151 is fixed to the drive belt 153 by a fixing component 152. As such, the image sensor 151 moves in the sub-scanning direction as the drive belt 153 moves.

The image sensor moving mechanism is therefore configured to allow the image sensor 151 to reciprocate in the sub-scanning direction below the inkjet heads 1, as illustrated in FIG. 2. While passing below each inkjet head 1, the image sensor 151 captures an image of the ink ejection surface 2*a* of that inkjet head 1. The captured image data corresponding to the captured image is transmitted to the control unit 40. It is noted that the resolution of the image sensor 151 is preferably high enough so that the existence of each ejection outlet 108*a* formed in the ink ejection surface 2*a* is recognizable.

Figure 3A:
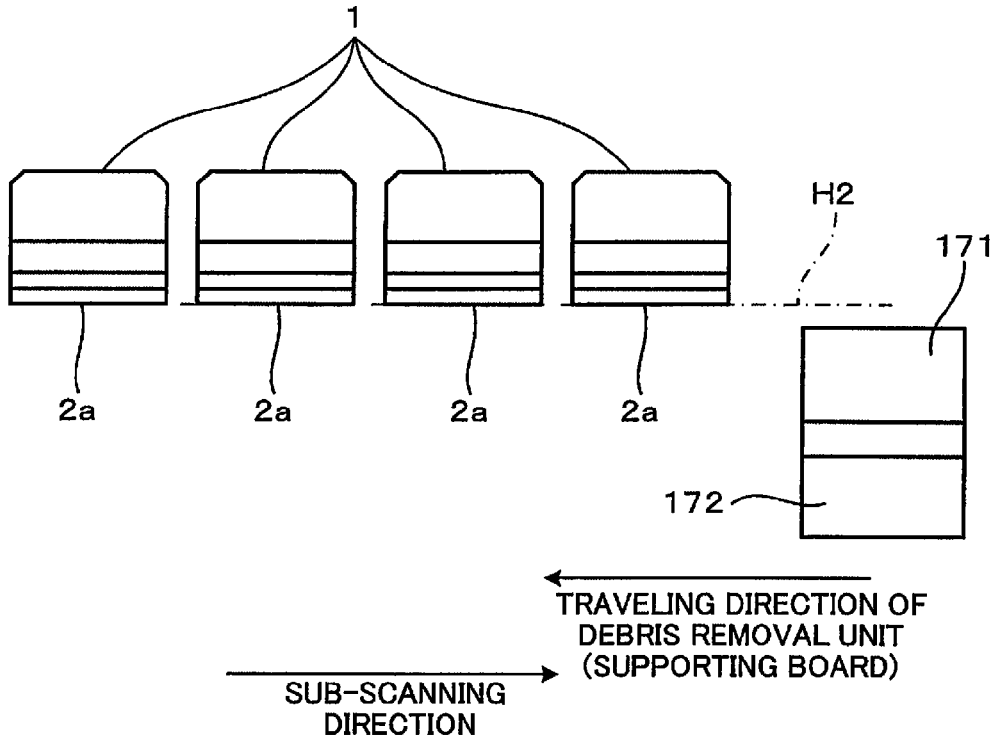
FIG. 3 includes a profile and elevation view around the inkjet heads and debris removal unit of FIG. 1.
Figure 3B:
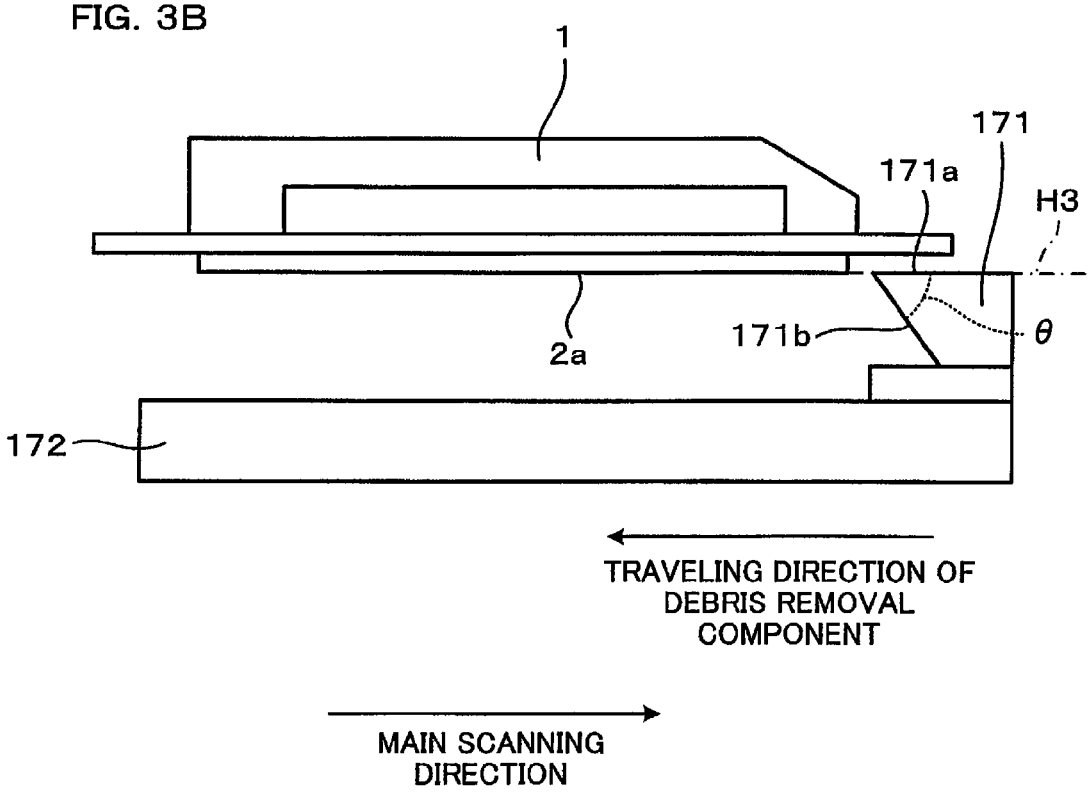

The inkjet printer 100 is further provided with a debris removal unit 170 which carries out debris removal. The debris removal is an operation to scrape off debris on the ink ejection surface 2*a* of each inkjet head 1. As illustrated in FIG. 1, FIG. 3A, and FIG. 3B, the debris removal unit 170 includes a debris removal component 171 and a supporting board 172 which supports the debris removal component 171. The supporting board 172 roughly has a rectangular parallelepiped shape and is long in the main scanning direction. The debris removal component 171 is supported on the upper surface of the supporting board 172 in such a way as to be movable in the main scanning direction. The debris removal component 171 is made of a resin material such as rubber. As illustrated in FIG. 1 and FIG. 3B, the upper surface 171*a* of the debris removal component 171 is horizontal, whereas the surface 171*b* of the debris removal component 171, which faces leftward in FIG. 3B, is disposed so that the angle θ between the surface 171*b* and the upper surface 171*a* is an acute angle. In the sub-scanning direction, the width of the debris removal component 171 is identical with the total width of the inkjet heads 1.

The debris removal unit 170 has a removal component moving mechanism which causes the debris removal component 171 to reciprocate on the supporting board 172 in the main scanning direction. This removal component moving mechanism includes a drive roller 173, an unillustrated driven roller, and a drive belt 174. The drive roller 173 and driven roller are horizontally distanced from each other in the main scanning direction. The drive belt 174 wraps these rollers. The drive roller is driven by an unillustrated drive motor and rotates about the rotational axis extending in the sub-scanning direction. As the drive roller 173 rotates, the drive belt 174 moves around the drive roller 173 and driven roller. In the meanwhile, the debris removal component 171 is fixed to the drive belt 174 and reciprocates in the main scanning direction as the drive belt 174 moves.

The inkjet printer 100 is further provided with a removal unit moving mechanism 180 which causes the entirety of the debris removal unit 170 to reciprocate in the sub-scanning direction. This removal unit moving mechanism 180 includes a drive roller 182, a driven roller 183, and a drive belt 181. The drive roller 182 and driven roller 183 are horizontally distanced from each other in the sub-scanning direction. The drive belt 181 wraps these rollers. In the meanwhile, the supporting board 172 is fixed to the drive belt 181 by a fixing component 175 and reciprocates in the sub-scanning direction as the drive belt 181 moves.

The debris removal unit 170 removes debris on the ink ejection surface 2*a* of each inkjet head 1 in the manner as described below. First, as illustrated in FIG. 3A, the head elevating mechanism 11 moves the inkjet heads 1 so that the ink ejection surfaces 2*a* are positioned at the height level H2 above the debris removal unit 170. This allows the debris removal unit 170 to pass below the inkjet heads 1. Then the removal unit moving mechanism 180 moves the debris removal unit 170 to a region below one of the four inkjet heads 1. It is noted that the debris removal component 171 is positioned to the right of the ink ejection surface 2*a* of the inkjet head 1 in FIG. 3B, before the debris removal is carried out. The head elevating mechanism 11 then moves the inkjet heads 1 until the ink ejection surfaces 2*a* become at the height level H3. the height level H3 is flush with the upper surface 171*a* of the debris removal component 171.

Thereafter, the removal component moving mechanism moves the debris removal component 171 leftward in FIG. 3(*b*) so that the debris removal component 171 passes below the ink ejection surface 2*a*. While the debris removal component 171 is moved in this way, the upper surface thereof is in contact with the ink ejection surface 2*a* and moves leftward. As a result of this, the debris on the ink ejection surface 2*a* is scraped off. Because the debris removal component 171 has the acute angle portion θ as illustrated in FIG. 3B, the debris on the ink ejection surface 2*a* is scraped off by this acute angle portion θ. Therefore the debris on the ink ejection surface 2*a* is surely scraped off in comparison with for example a case where the angle between the surfaces 171*a* and 171*b* is not an acute angle but right angle.

Figure 4:
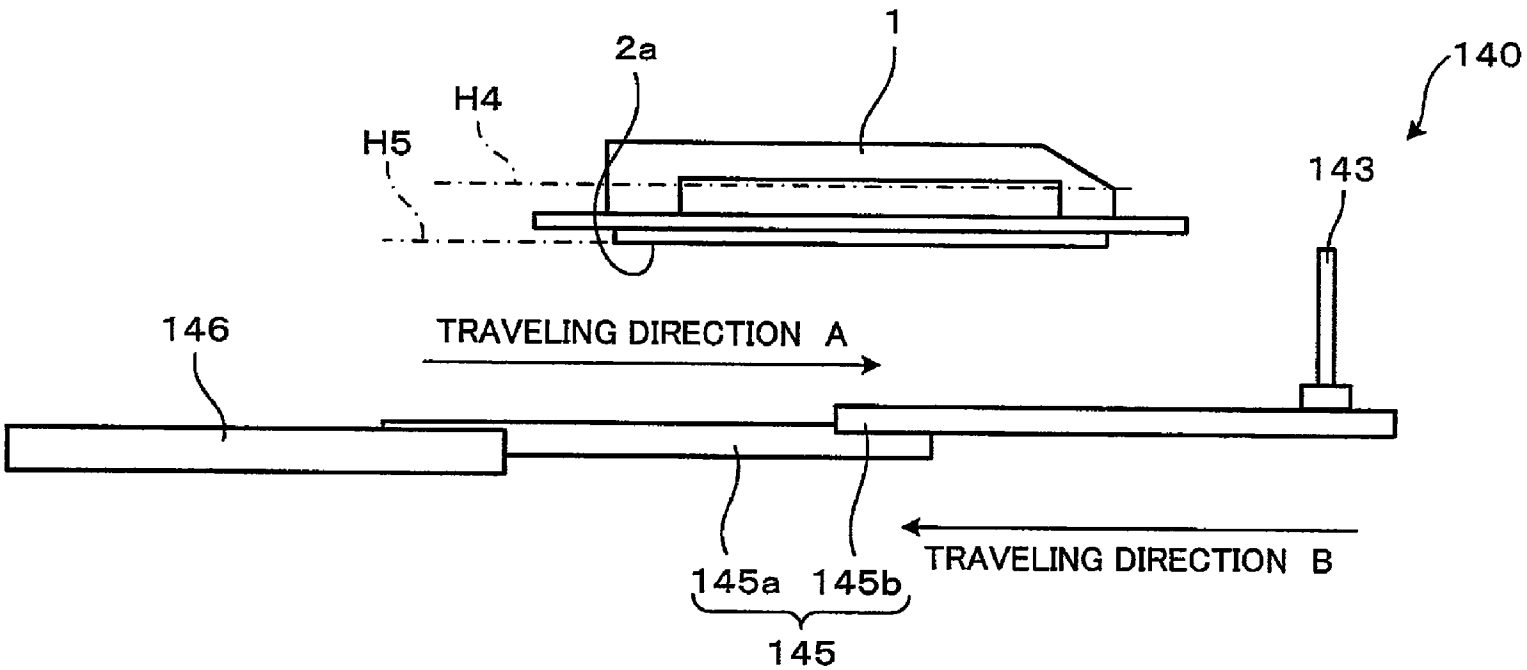
FIG. 4 is an elevation view which illustrates a situation where a maintenance unit cleans the inkjet head of FIG. 1.

As illustrated in FIGS. 1 and 4, the inkjet printer 100 is further provided with a maintenance unit 140. The maintenance unit 140 carries out ejection surface maintenance, that is, cleans the ink ejection surface 2*a* by scraping off the ink on the ink ejection surface 2*a*. The maintenance unit 140 has a wiper blade 143, a movable board 145, and a fixed board 146. The movable board 145 and the fixed board 146 support the wiper blade 143 and each has a horizontal upper surface. The fixed board 146 is a plate horizontally fixed to the inkjet printer 100. The movable board 145 is disposed on the fixed board 146 so as to be able to reciprocate in the main scanning direction. The movable board 145 is constituted by trays 145*a* and 145*b* as illustrated in FIG. 4. The tray 145*a* is supported by the tray 145*b* so as to be movable beyond the right edge of the tray 145*b* in FIG. 4. The tray 145*b* is supported by the fixed board 146 so as to be movable rightward from the right edge of the fixed board 146 in FIG. 4.

The wiper blade 143 is fixed on the upper surface of the movable board 145. The wiper blade 143 has a rectangular parallelepiped shape and whose longer sides extend in the sub-scanning direction and shorter sides extend in the vertical direction, and is made of an elastic material such as rubber. The upper surface of the wiper blade 143 is formed to be horizontal. The wiper blade 143 is arranged to cross over the four inkjet heads 4 in the sub-scanning direction. The wiper blade 143 can therefore simultaneously clean the inkjet ejection surfaces 2*a* of the four inkjet heads 1.

The maintenance unit 140 is further provided with a movable board moving mechanism which moves the movable board 145. This movable board moving mechanism has a driven roller 147, a drive roller 149, and a drive belt 148. The driven roller 147 and the drive roller 149 are horizontally distanced from each other in the main scanning direction, and are provided in the inkjet printer 100 so as to be rotatable about the rotational axes extending in the sub-scanning direction. The drive roller 149 is driven by an unillustrated drive motor. The drive belt 148 wraps the driven roller 147 and the drive roller 149. In the meanwhile, the movable board 145 is fixed to the drive belt 148 by a fixing component 144. Therefore, as the drive roller 149 rotates, the drive belt 148 moves around the driven roller 147 and the drive roller 149, so that the movable board 145 is moved in the main scanning direction through the intermediary of the fixing component 144.

The maintenance unit 140 scrapes off the ink adhering to the ink ejection surface 2*a* of the inkjet head 1 as below. First, the head elevating mechanism 11 moves the inkjet head 1 to the height H4 which is above the upper edge of the maintenance unit 140. This allows the wiper blade 143 to pass below the inkjet head 1. The movable board moving mechanism then moves the movable board 145 in the moving direction A of FIG. 4 so that the movable board 145 passes under the ink ejection surface 2*a*. Subsequently, the head elevating mechanism 11 lowers the inkjet head 1 so that the ink ejection surface 2*a* is at the height H5 which is as high as the upper edge of the wiper blade 143. FIG. 4 shows this state. The movable board moving mechanism then moves the movable board 145 in the moving direction B of FIG. 4 so that the movable board 145 passes under the ink ejection surface 2*a*.

As this occurs, the wiper blade 143 moves leftward while the upper surface thereof is in contact with the ink ejection surface 2*a*, as a result the ink adhered to the ink ejection surface 2*a* is scraped off. Furthermore, from the later-detailed ejection outlet 108*a* of the nozzle 108 on the ink ejection surface 2*a*, redundant ink is scraped off by the upper surface of the wiper blade 143, and hence the shape of ink meniscus is regulated.

Now, referring to FIG. 5 to FIG. 7, the head main body 2 below the inkjet head 1 is discussed below. In FIG. 6, pressure chamber 110, apertures 112, and nozzles 108 below an actuator unit 21 are drawn by full lines for the sake of simplicity, although they should be drawn by dotted lines in a strict sense.

Figure 5:
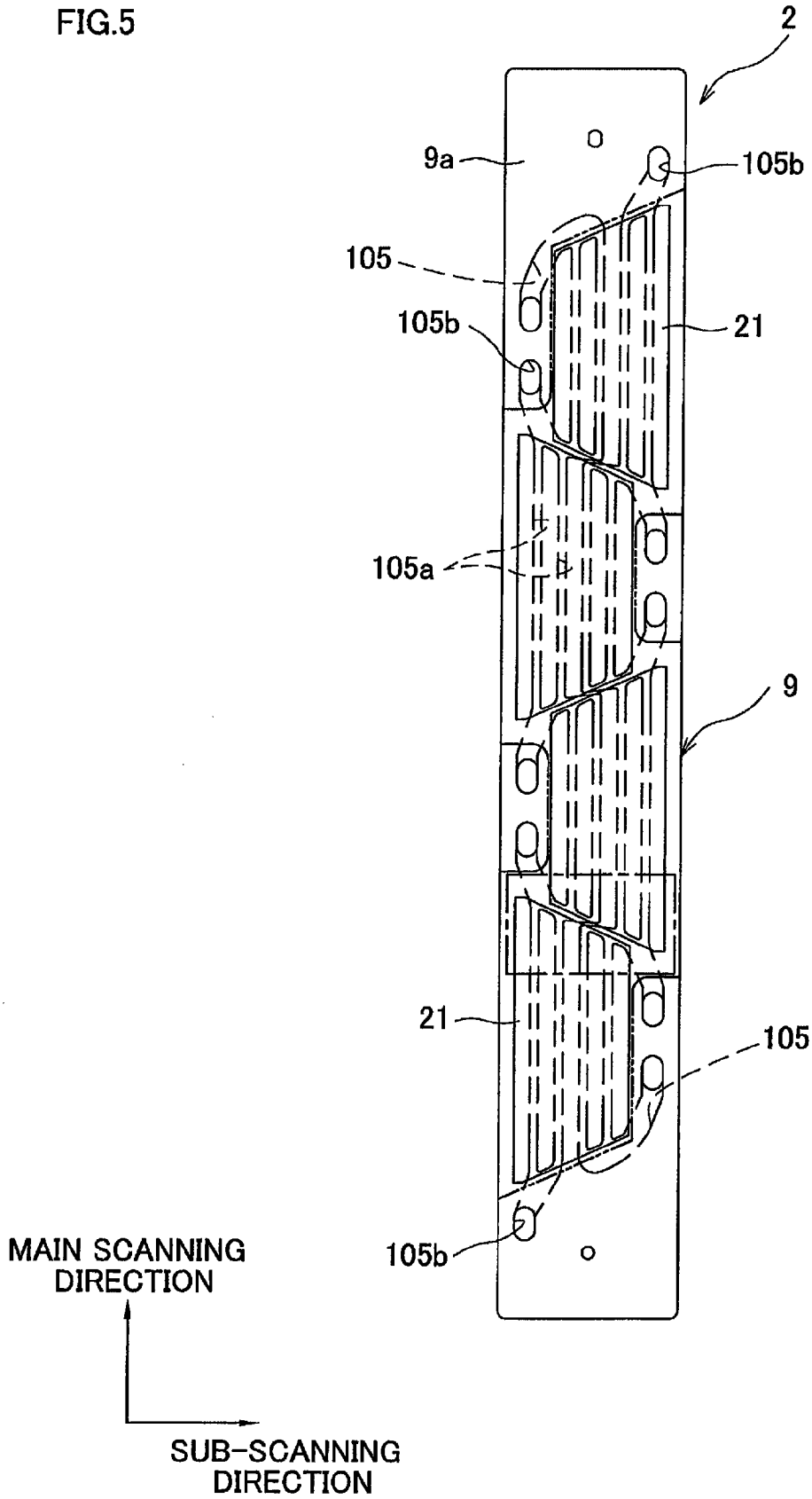
FIG. 5 is a plan view of the head main body of FIG. 1.
Figure 6:
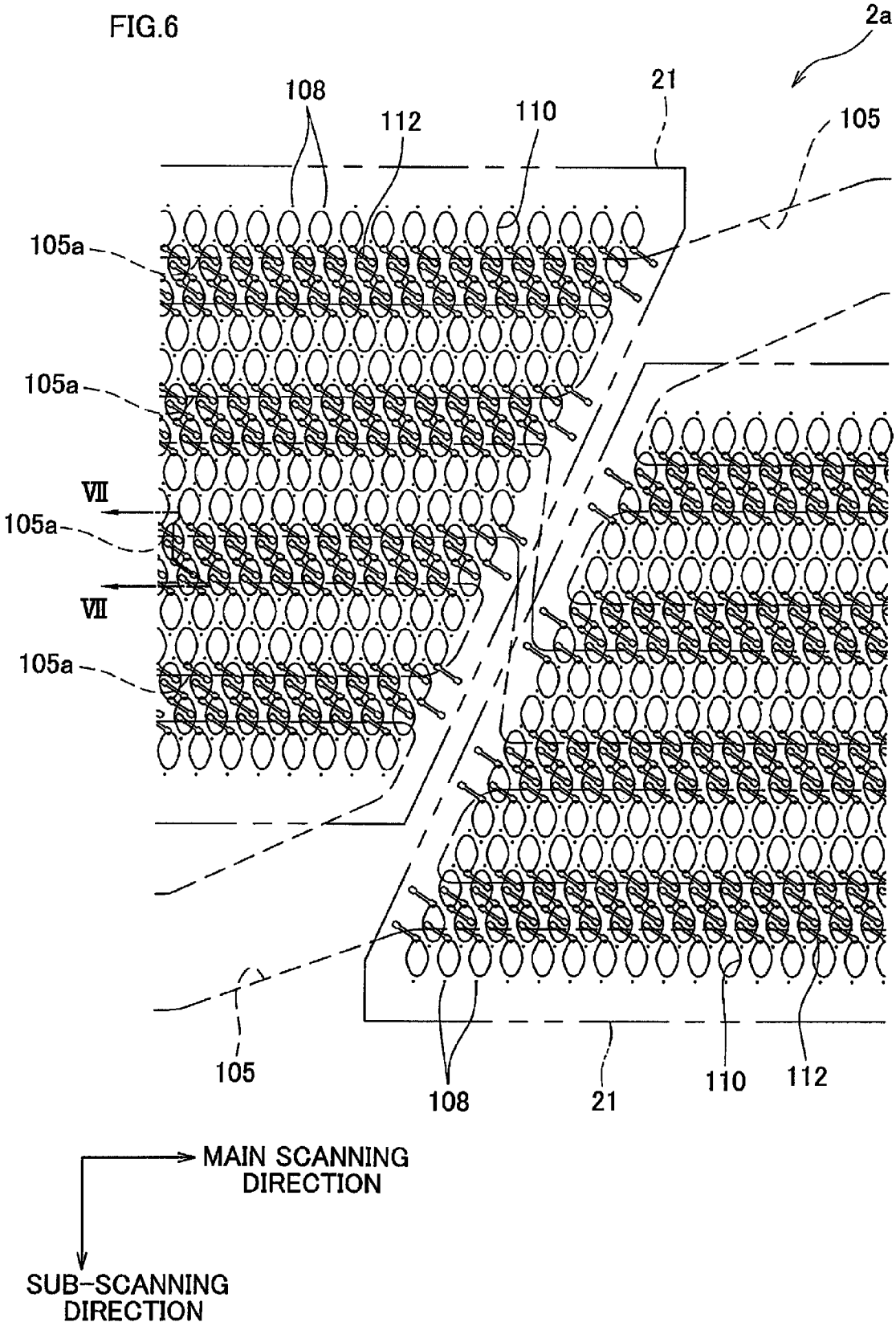
FIG. 6 is an enlarged view of the region contained in the dashed lines in FIG. 3.

As illustrated in FIG. 5, the head main body 2 is arranged so that four actuator units 21 are fixed on the upper surface 9*a* of a path unit 9. As FIG. 6 illustrates, each actuator unit 21 has two or more actuators facing the pressure chambers 110 formed on the path unit 9, and is capable of selectively imparting an ejection energy to the ink in the pressure chambers 110. The inkjet head 1 is provided with an unillustrated substrate and driver IC. In response to a printing instruction from the control unit 40, a drive signal is supplied to the actuator units 21 via the substrate and driver IC. Receiving this drive signal, each actuator unit 21 imparts an ejection energy to the ink in the pressure chambers 110.

The path unit 9 has a rectangular parallelepiped shape. The upper surface 9*a* of the path unit 9 has 10 ink supply openings 105*b* to which ink is supplied from an unillustrated reserver unit. The reserver unit is in the inkjet head 1 and supplies, to the path unit 9, the ink which has been supplied from an unillustrated ink tank to the inkjet head 1.

Formed in the path unit 9 are manifold paths 105 connected to the ink supply openings 105*b* and sub-manifold paths 105*a* branched from the manifold paths 105. The path unit 9 has many nozzles 108. As illustrated in FIG. 7, the under surface of the path unit 9 is equivalent to the ink ejection surface 2*a* and the nozzles 108 are provided as ejection outlets 108*a*. The nozzles 108 are disposed in a matrix manner in a plan view in such a way that, when the nozzles 108 are projected in the sub-scanning direction onto a virtual straight line which is in parallel to the main scanning direction, the projective points of the nozzles 108 are aligned at regular intervals on the virtual straight line. The inkjet head 1 can therefore form, by the ink ejected from the nozzles 108, dots at regular intervals on a media sheet P in the main scanning direction. For example, in case where the projective points are aligned on the virtual straight line at intervals of 1/600 inch, dots are formed with the resolution of 600 dpi in the main scanning direction. The nozzles 108 are fully distributed in the region which is entirely covered by a single actuator unit 21 in plan view. The shape of the region where the nozzles 108 are formed is therefore trapezoidal and identical with the shape of the actuator unit 21 (see FIG. 9). The pressure chambers 110 are also many in number and disposed in a matrix manner, on the surface of the path unit 9 onto which surface the actuator units 21 are fixed.

Figure 7:
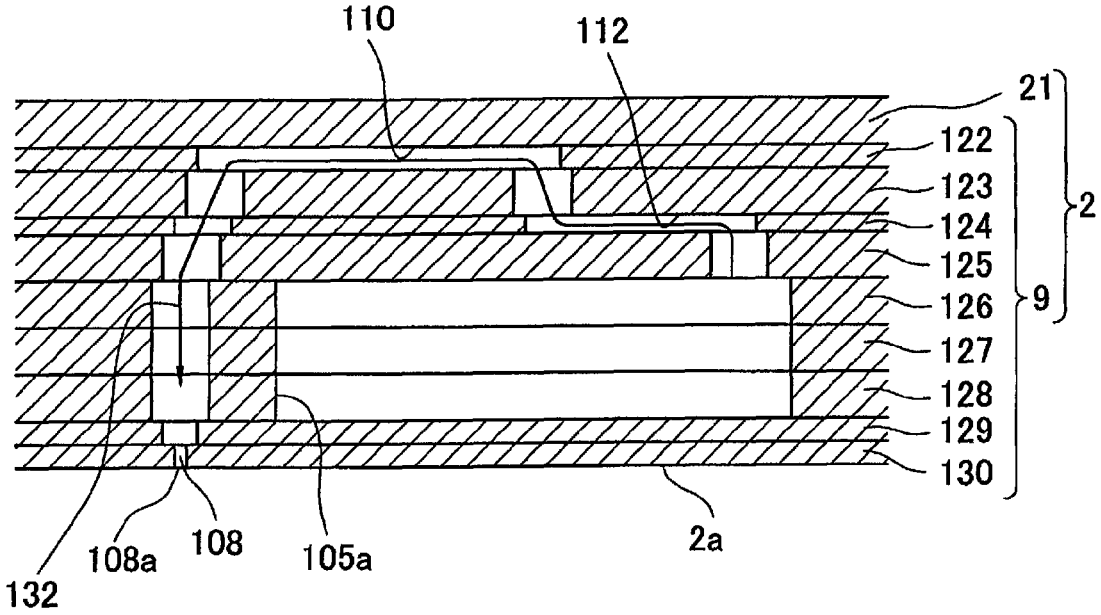
FIG. 7 is a fragmentary cross sectional view taken at line VII-VII of FIG. 6.

As illustrated in FIG. 7, the path unit 9 is constituted by 9 metal plates 122 to 130 which are made of stainless steel or the like. Each of these plates 122 to 130 has a rectangular plan view and is long in the main scanning direction. These plates 122 to 130 are aligned with one another and deposited so that the through holes penetrating each of the plates 122 to 130 are connected with one another. As a result, in the path unit 9, many individual ink flow paths 132 each of which extends from the manifold path 105 to the nozzle 108 via the sub-manifold path 105*a*, the outlet of the sub-manifold path 105*a*, and the pressure chamber 110 are formed.

After being supplied from the reserver unit to the path unit 9, the ink flows into the individual ink flow paths 132 via the manifold paths 105 (sub-manifold paths 105*a*), and then reaches the nozzles 108 via restricted paths 112 and the pressure chambers 110.

Figure 8:
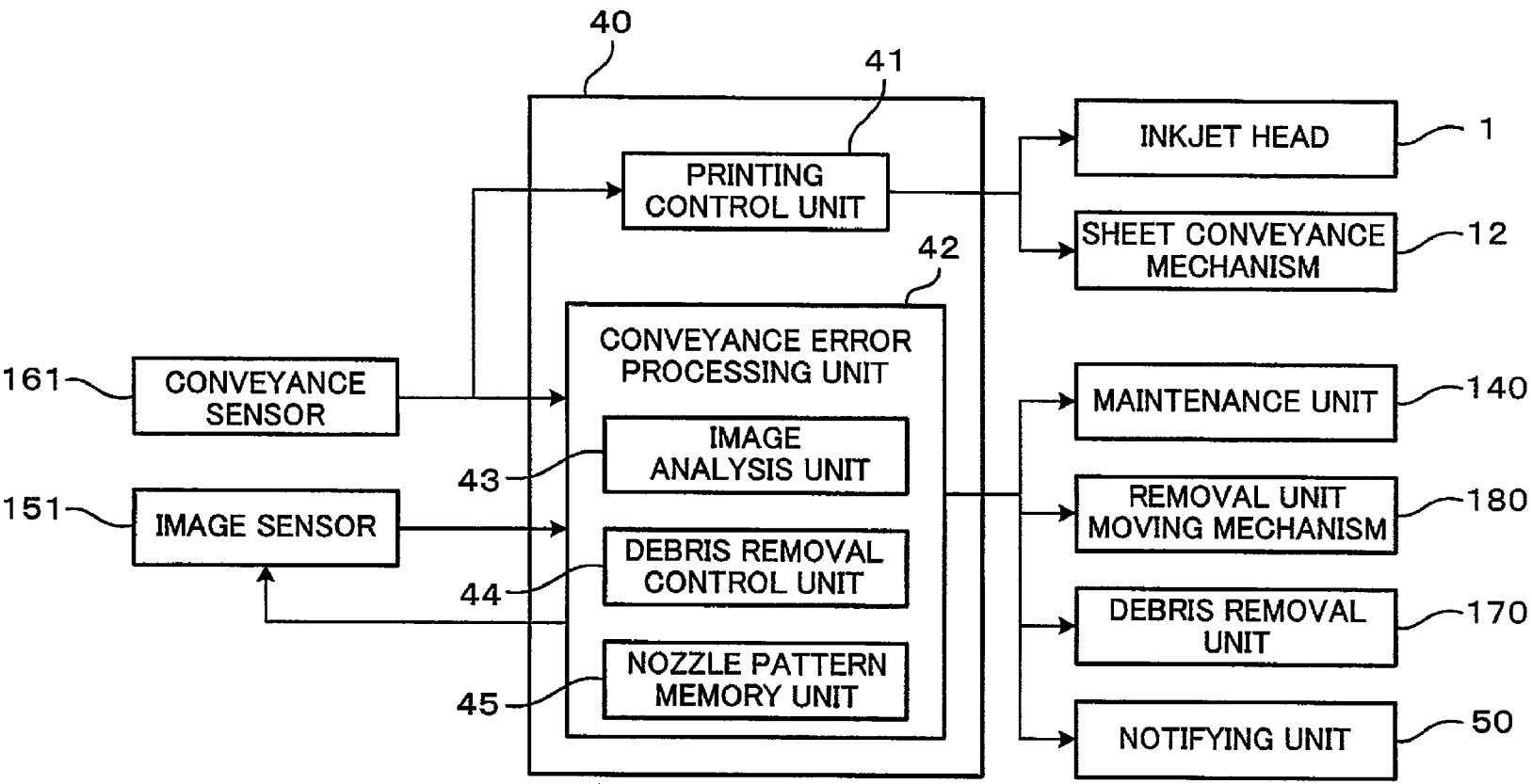
FIG. 8 is a block diagram of the control unit of FIG. 1.

The control unit 40 is discussed below with reference to FIG. 8. The control unit 40 is constituted by hardware such as a processor circuit and a memory and software such as a program which causes the hardware to function as a functional block such as a later-detailed printing control unit 41.

The control unit 40 has a printing control unit 41 and a conveyance error processing unit 42. The printing control unit 41 causes the inkjet head 1 to eject ink and causes the sheet conveyance mechanism 12 to convey a media sheet P so that an image corresponding to image data supplied from an external device or the like is formed on a media sheet P.

When the sheet conveyance mechanism 12 conveys a media sheet to the region below the inkjet head 1, a conveyance error of the media sheet P may occur. A conveyance error of a media sheet P occurs in such a way that, for example, a media sheet P is jammed between the pickup roller 15 and the conveyor belt 14 or is caught by the inkjet head 1, for the reason that the media sheet P is folded or curled. Taking account of this, each conveyance sensor 161 detects whether the media sheet P has passed through or not and sends the detection result to the control unit 40. Based on the detection results of the conveyance sensors 161, the printing control unit 41 determines that a conveyance error has occurred if the media sheet P does not pass under one of the conveyance sensors 161 within a predetermined period of time, even if the sheet conveyance mechanism 12 is performing the process of conveying the media sheet P. When it is determined that a conveyance error has occurred, the inkjet head 1 and the sheet conveyance mechanism 12 are stopped so that the printing process is discontinued.

The detection results of the conveyance sensors 161 are also supplied to the conveyance error processing unit 42. Based on the detection results of the conveyance sensors 161, the conveyance error processing unit 42 executes the following recovery process to recover from the conveyance error. First, the conveyance error processing unit 42 controls the sheet conveyance mechanism 12 and the image sensor 151 so as to cause the image sensor 151 to capture an image of the inkjet head 1. The captured image data is supplied from the image sensor 151 to the conveyance error processing unit 42. The conveyance error processing unit 42 has an image analysis unit 43 which analyzes captured image data supplied from the image sensor 151.

When a sheet conveyance error occurs in the vicinity of the inkjet head 1, fragments of a broken media sheet P may adhere to the inkjet head 1. There is also a possibility that a media sheet P entirely adheres to the inkjet head 1 if the sheet is small in size. If a media sheet or fragments thereof adheres to the ink ejection surface 2*a*, the ejection outlets 108*a* may be blocked and hence the ink ejected through the ejection outlets 108*a* may not be deposited onto a media sheet P. Leaving the inkjet head 1 in this state decreases the quality of images formed on a media sheet P. For this reason, upon detection of a conveyance error by the conveyance sensors 161, the image analysis unit 43 determines whether a media sheet or fragments thereof adheres to the ink ejection surface 2*a*, based on the captured image data supplied from the image sensor 151. This is because, since the conveyance sensors 161 are disposed in the vicinity of the inkjet head 1, the detection of a conveyance error by a conveyance sensor 161 may indicate that a media sheet or fragments thereof adheres to the ink ejection surface 2*a*.

Figure 9:
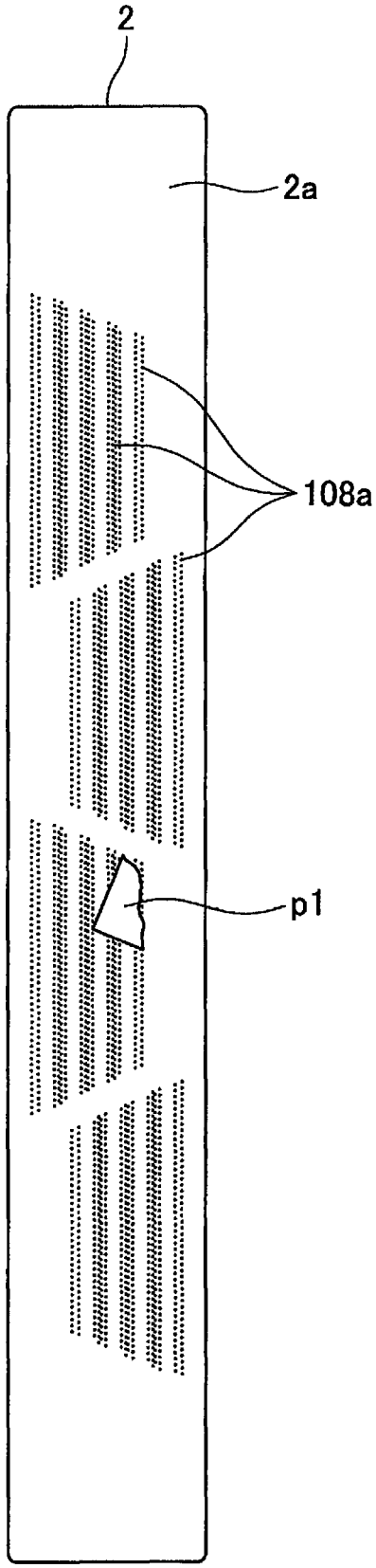
FIG. 9 is a bottom view of the inkjet head when paper dust adheres to the ink ejection surface of the inkjet head of FIG. 1.

In case where the captured image data supplied from the image sensor 151 indicates as shown in FIG. 9 that paper dust p1 adheres to the ink ejection surface 2*a*, the image analysis unit 43 determines that paper dust adheres to the ink ejection surface 2*a*. The image analysis unit 43 also determines to which one of the four inkjet heads 1 the ink ejection surface 2*a* to which the paper dust p1 adheres belongs.

Specifically, the determination is carried out as below. The conveyance error processing unit 42 has a nozzle pattern memory unit 45. The nozzle pattern memory unit 45 stores pattern data indicating a formation pattern of the ejection outlets 108 in plan view as shown in FIG. 9. The nozzle pattern memory unit 45 may store planar positional data of each ejection outlet 108*a* as pattern data, or may store, as pattern data, data schematically showing the range in which the ejection outlets 108*a* are formed. For example, on the ink ejection surface 2*a* there are four trapezoidal regions in which the ejection outlets 108*a* are formed. Stored as pattern data may be the data indicating a position, size, and range of each of these trapezoidal regions.

The image analysis unit 43 then analyzes the captured image data supplied from the image sensor 151 and determines whether the paper dust p1 is observed in the region where the ejection outlets 108*a* are supposed to be formed, based on the pattern data of the ejection outlets 108*a* stored in the nozzle pattern memory unit 45. This determination by analyzing the captured image data supplied from the image sensor 151 may be made, for example, in such a way that, for each ejection outlet 108*a* it is determined whether image data of a position where an ejection outlet 108*a* is formed shows a color equivalent to that of the ink. Alternatively, the determination by analyzing the captured image data supplied from the image sensor 151 may be made in such a way that it is determined whether an image having a color equivalent to that of paper dust is observed in a trapezoidal region where the ejection outlets 108*a* are formed. The image analysis unit 43 recognizes to which inkjet head 1 the paper dust p1 adheres. In other words, the image analysis unit 43 recognizes in what range of the ink ejection surfaces 2*a* the paper dust p1 adheres, in the ink ejection surfaces 2*a* of the four inkjet heads 1.

The conveyance error processing unit 42 has a debris removal control unit 44 which causes the debris removal unit 170 to perform debris removal in order to remove paper dust. When the image analysis unit 43 determines that paper dust adheres to the ink ejection surface 2*a* based on the captured image data supplied from the image sensor 151, the debris removal control unit 44 controls the debris removal unit 170 and the removal unit moving mechanism 180 so that the paper dust adhering to the ink ejection surface 2*a* is removed. In so doing, the debris removal control unit 44 causes the removal unit moving mechanism 180 to move the debris removal unit 170 to a position corresponding to the inkjet head 1 which has the ink ejection surface 2*a* to which the paper dust adheres according to the determination of the image analysis unit 43. This allows the debris removal unit 170 to perform the debris removal surely in the range of the ink ejection surface 2*a* in which range the paper dust adheres. Then the debris removal unit 170 is activated so that the paper dust adhering to the ink ejection surface 2*a* of the inkjet head 1 is removed by the debris removal unit 170.

When the image analysis unit 43 determines that the paper dust adheres to the ink ejection surface 2*a*, the conveyance error processing unit 42 causes the notifying unit 50 to notify that the debris removal is being performed because the paper dust adheres to the ink ejection surface 2*a*. In so doing, it is preferable to further notify to which inkjet head 1 the paper dust adheres. When the paper dust cannot be removed even by the debris removal, the user may manually remove the paper dust. The user can swiftly remove the paper dust if he/she is notified of to which inkjet head 1 the paper dust adheres.

After the debris removal by the debris removal unit 170, the conveyance error processing unit 42 causes the maintenance unit 140 to perform ejection surface maintenance. When paper dust adheres to the ink ejection surface 2*a*, the ink ejection surface 2*a* may be contaminated with ink because, for example, redundant ink around the ejection outlet 108*a* of the nozzle 108 may enter the space between the paper dust and the ink ejection surface 2*a*. The contamination of the ink ejection surface 2*a* is removed by performing the ejection surface maintenance after the debris removal as described above.

Figure 10:
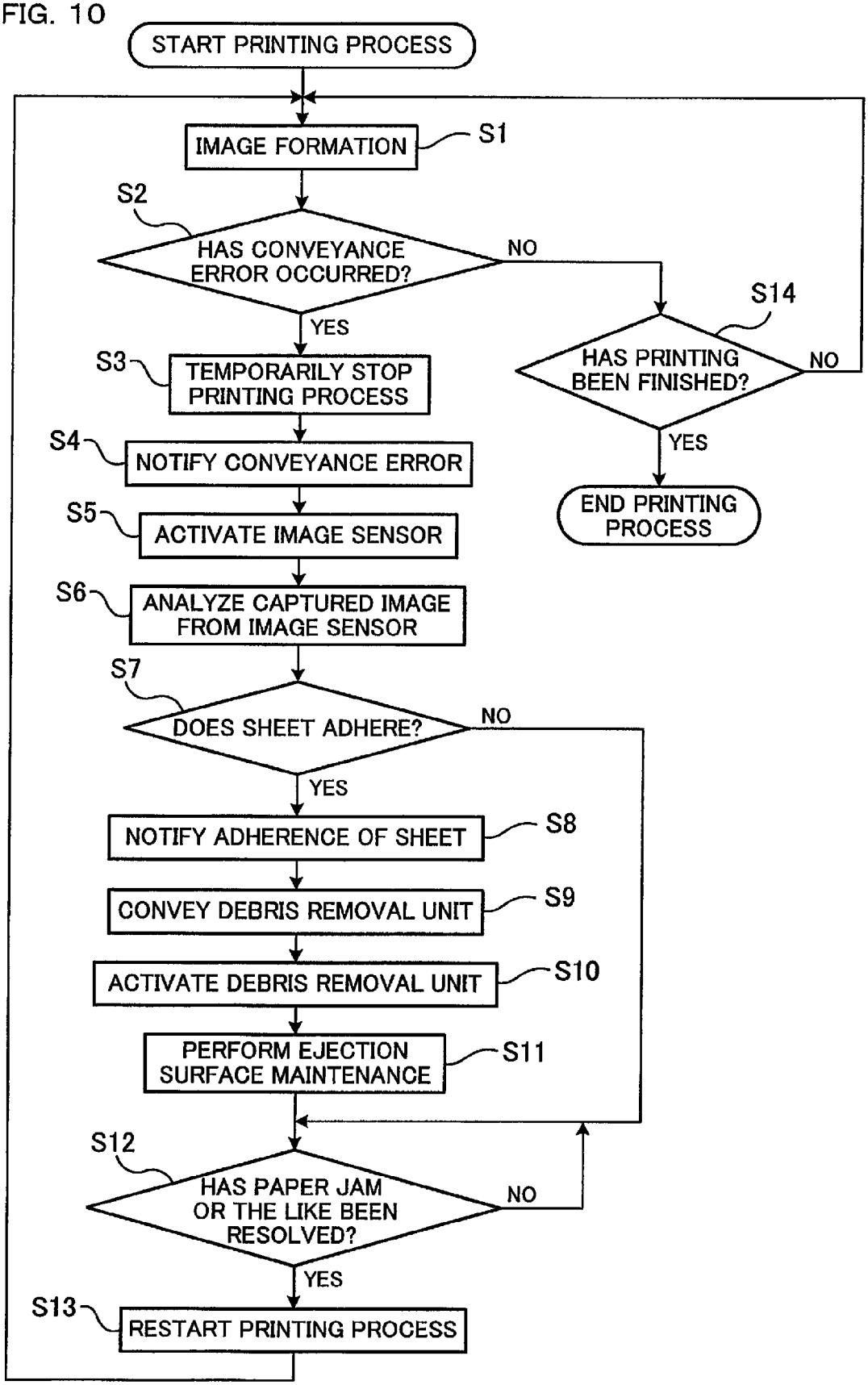
FIG. 10 is a flowchart of the steps that the control unit of FIG. 8 executes during the printing process.

The following describes the steps that the control unit 40 performs during the printing process, with reference to FIG. 10. As the printing process starts, the printing control unit 41 controls the inkjet head 1 and the sheet conveyance mechanism 12 so that an image is formed on a media sheet P (S1). The control unit 40 then determines whether a conveyance error has occurred, based on the detection results of the conveyance sensors 161 (S2). If it is determined that no conveyance error has occurred (S2, NO), the printing control unit 41 determines whether all jobs of the printing process have been finished (S14). If it is determined that all jobs of the printing process have been finished (S14, YES), the printing process ends. If the printing control unit 41 determines that at least one job of the printing process has not been finished (S14, NO), the control unit 40 repeats the steps from S1.

If it is determined in S2 that a conveyance error has occurred (S2, YES), the printing control unit 41 temporarily aborts the printing process (S3). The conveyance error processing unit 42 then causes the notifying unit 50 to notify that a conveyance error has occurred (S4). For example, the notifying unit 50 sends a message of instructing the user to remove a jammed sheet. The conveyance error processing unit 42 then activates the image sensor 151 to capture an image of the ink ejection surfaces 2*a* of the inkjet head 1 (S5). Subsequently, the image analysis unit 43 analyzes the captured image data supplied from the image sensor 151 (S6).

The image analysis unit 43 determines whether paper dust adheres to the ink ejection surface 2*a* (S7). If the image analysis unit 43 determines that no paper dust adheres (S7, NO), the steps from S12 are executed.

If the image analysis unit 43 determines that paper dust adheres (S7, YES), the conveyance error processing unit 42 causes the notifying unit 50 to notify that paper dust adheres to the ink ejection surface 2*a* and the debris removal is being executed (S8). Then the debris removal control unit 44 causes the removal unit moving mechanism 180 to move the debris removal unit 170 to a position corresponding to the inkjet head 1 to which the paper dust adheres (S9). The debris removal control unit 44 then causes the debris removal unit 170 to execute the debris removal to remove the paper dust from the ink ejection surface 2*a* (S10). Furthermore, the conveyance error processing unit 42 causes the maintenance unit 140 to perform the ejection surface maintenance (S1).

Thereafter, the control unit 40 is put on hold until paper jam or the like is resolved (S12, NO). For example, when paper jam or the like occurs due to a conveyance error, the user is instructed to remove the jammed sheet. The inkjet printer 100 includes therein a means (not illustrated) to detect whether paper jam is resolved. Based on the detection result of such a detection means, the control unit 40 determines whether paper jam or the like is resolved. When it is determined that the paper jam or the like is resolved (S12), the printing control unit 41 restarts the printing process (S13). The control unit 40 thereafter executes the steps from S1.

According to the first embodiment described above, whether paper dust adheres to the ink ejection surface 2*a* is properly determined. It is therefore possible to suitably perform the debris removal required for scraping off paper dust and notify the user of the debris removal, when it is determined that paper dust adheres. According to the first embodiment, furthermore, the image sensor 151 directly captures an image of the ink ejection surface 2*a*. It is therefore possible to certainly capture an image of the paper dust adhering to the ink ejection surface 2*a*.

Second Embodiment

The following discusses the second embodiment of the present invention with reference to FIGS. 11A to 14. In the second embodiment, the features identical with those in the first embodiment may not be explained. Also, the same reference numbers are used throughout the first and second embodiments.

Figure 11A:
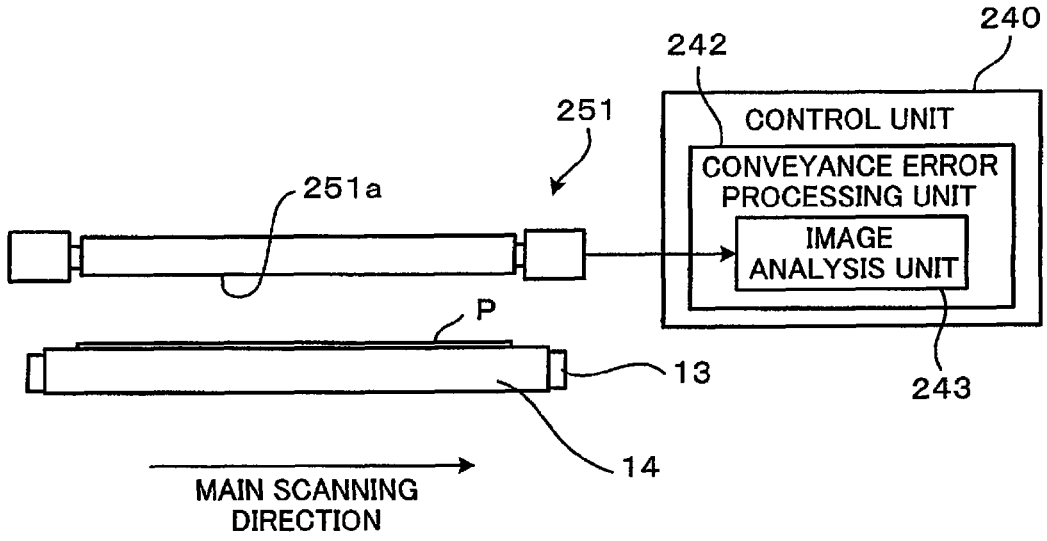
FIG. 11 is an elevation view of an image sensor of a second embodiment of the present invention.

In the second embodiment, an image sensor 251 of FIG. 11A is provided in place of the image sensor 151 of the first embodiment. The image sensor 251 is fixed inside the inkjet printer 100. The under surface of the image sensor 251 functions as a reader surface 251*a*. The image sensor 251 is disposed so that the reader surface 251*a* is slightly above the conveyor belt 14, thereby allowing the image sensor 251 to capture an image which is formed on a media sheet P by the ink ejected from the inkjet head 1. An image captured by the image sensor 251 is supplied to a image analysis unit 243 of a control unit 240.

The control unit 240 of the second embodiment is equivalent to the control unit 40 of the first embodiment. The control unit 240 is identical with the control unit 40 except that the former includes a conveyance error processing unit 242 in place of the conveyance error processing unit 42. The conveyance error processing unit 242 is identical with the conveyance error processing unit 42 except that the former includes an image analysis unit 243 in place of the image analysis unit 43.

Figure 11B:
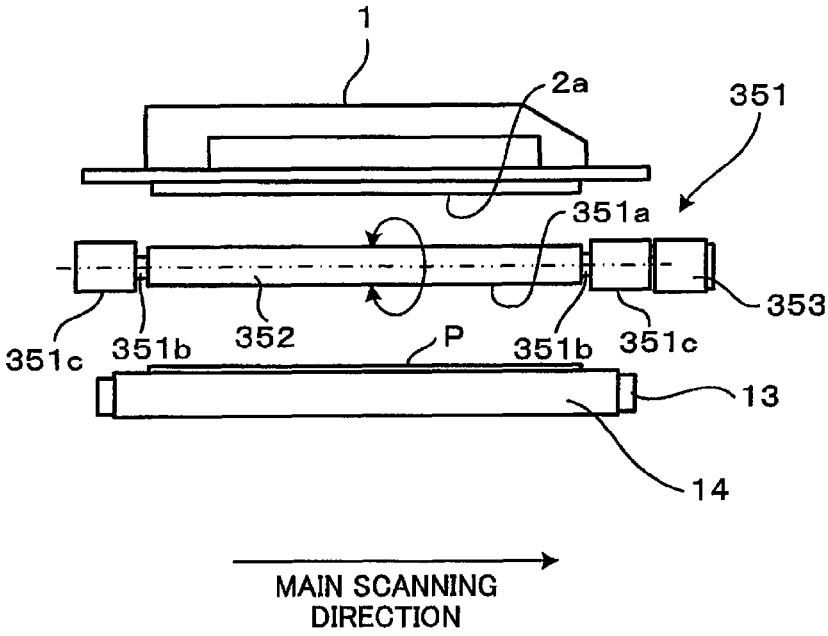

In place of the image sensor 251, an image sensor 351 of FIG. 11B may be provided. The image sensor 351 includes: a sensor main body 352 having a reader surface 351*a*; shaft members 351*b* fixed to the both ends of the sensor main body 352; and supporting members 351*c* which support the shaft member 351*b* from left and right in FIG. 11B. The supporting member 351*c* supports the shaft member 351*b* so that the sensor main body 352 is rotatable about the two-dot chain line of FIG. 11B. Constructed inside the supporting member 351*c* is a rotation drive mechanism (not illustrated) which causes the sensor main body 352 to rotate about the aforesaid two-dot chain line. In addition, an image sensor moving mechanism 353 is provided in the present embodiment. The image sensor moving mechanism 353 is capable of moving the image sensor 351 to a position below each inkjet head 1, along the sub-scanning direction.

Having the arrangement above allows the image sensor 351 to be selectively switched between the state in which the reader surface 351*a* faces down and the state in which the reader surface 351*a* faces up. In the state in which the reader surface 351*a* faces down, the image sensor 351 can capture an image formed on a media sheet P. On the other hand, in the state in which the reader surface 351*a* faces up, the image sensor 351 can capture an image of the ink ejection surface 2*a*. This arrangement can therefore handle both the first embodiment of capturing an image of the ink ejection surface 2*a* and the second embodiment of capturing an image formed on a media sheet P.

Figure 12:
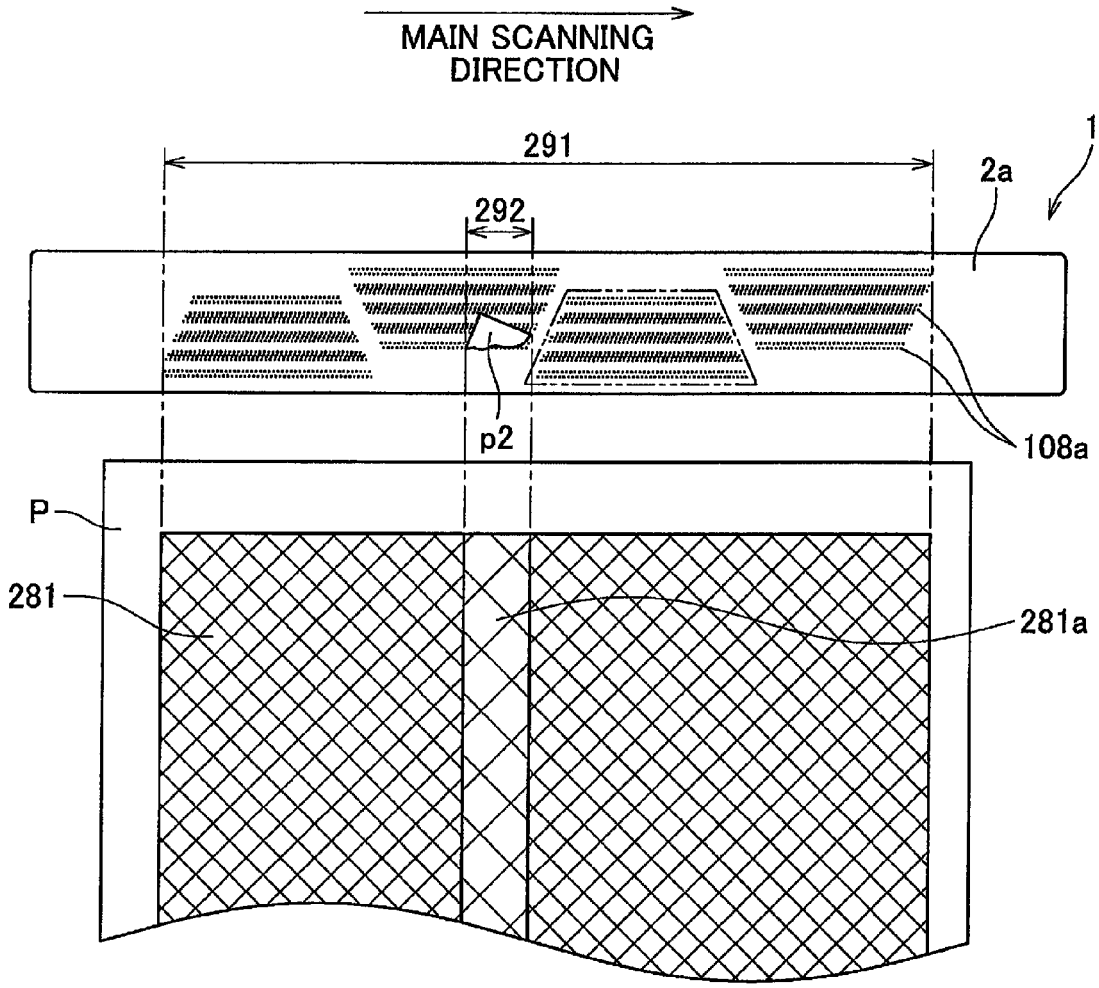
FIG. 12 relates to the second embodiment and is a schematic view showing the relationship between a test pattern image formed on a media sheet and the distribution of the ejection outlets on the ink ejection surface.

Now, the following discusses a method of the second embodiment of determining whether paper dust adheres to the ink ejection surface 2*a*. In the second embodiment, whether paper dust adheres to the ink ejection surface 2*a* is determined based on a test pattern image formed on a media sheet P. Although any types of test pattern images are usable, a test pattern image 281 of the present embodiment is, as shown in FIG. 12, a rectangular solid image which is entirely colored without any blank space by the ink ejected from each inkjet head 1. Such a solid image is formed by continuously ejecting ink from all ejection outlets 108*a* on the ink ejection surface 2*a*. As shown in FIG. 12, the test pattern image 281 is therefore as wide as, in the main scanning direction, the region 291 in which the ejection outlets 108*a* are formed.

When, for example, paper dust p2 adheres to the ink ejection surface 2*a* as shown in FIG. 12, the paper dust p2 blocks the ejection outlets 108*a* and hence the flight paths of ink droplets from the ejection outlets 108*a* to a media sheet P are blocked. For this reason, in the main scanning direction, an amount of deposited ink in a range 281*a*, which is a part of a test pattern image 281 and corresponds to a region 292 where the paper dust p2 adheres, is smaller on the whole than in the remaining parts of the test pattern image 281.

In this regard, based on the captured image data supplied from the image sensor 251, the image analysis unit 243 continuously checks the state of deposition of ink in the test pattern image 281 formed on the media sheet P, along the main scanning direction. For example, when the inkjet heads 1 are structured to be capable of forming dots at intervals of 600 dpi in the main scanning direction, the image analysis unit 243 checks whether dots are formed at intervals of 1/600 inch in the main scanning direction, so as to recognize a location where no dot is formed.

The image analysis unit 243 then recognizes which ejection outlet 108*a* corresponds to the location where no dot is formed, based on the pattern data of the ejection outlets 108*a* stored in the nozzle pattern memory unit 45. In the present embodiment, the nozzle pattern memory unit 45 stores the position of each ejection outlet 108*a* in both the main scanning direction and the sub-scanning direction. As described in the first embodiment, the ejection outlets 108*a* are disposed in such a way that, when the nozzles 108 are projected in the sub-scanning direction onto a virtual straight line which is in parallel to the main scanning direction, the projective points of the nozzles 108 are aligned at regular intervals on the virtual straight line. For this reason, in the main scanning direction, the locations on the test pattern image 281 where dots are supposed to be formed one-to-one correspond to the locations of the ejection outlets 108*a* on the ink ejection surface 2*a*. It is therefore possible to recognize which ejection outlet 108*a* corresponds to a location where a dot must have been formed, by collating the locations of the ejection outlets 108*a* in the main scanning direction stored in the nozzle pattern memory unit 45 with the locations in the main scanning direction where no dots are formed on the test pattern image 281.

The image analysis unit 243 then recognizes the distribution of the ejection outlets 108*a* which failed to form dots on the ink ejection surface 2*a*, based on the locations of the ejection outlets 108*a* in both the main scanning direction and the sub-scanning direction, which are stored in the nozzle pattern memory unit 45. The regions 293 to 295 in FIG. 13 respectively show three examples of the distribution of the ejection outlets 108*a*, which is recognized by the image analysis unit 243. Based on the recognized distribution, the image analysis unit 243 determines whether paper dust adheres to the ink ejection surface 2*a*. More specifically, when the recognized distribution indicates that two or more ejection outlets 108*a* are observed in a closed region, for example, when, as in the case of the region 293 of FIG. 13, two or more ejection outlets 108*a* are observed in the closed region 293*a* and the closed region 293*b* in th region 293, the image analysis unit 243 determines that paper dust adheres. It is noted that the region 293 corresponds to a region where the ejection outlets 108*a* blocked by the paper dust p2 are disposed.

Figure 13:
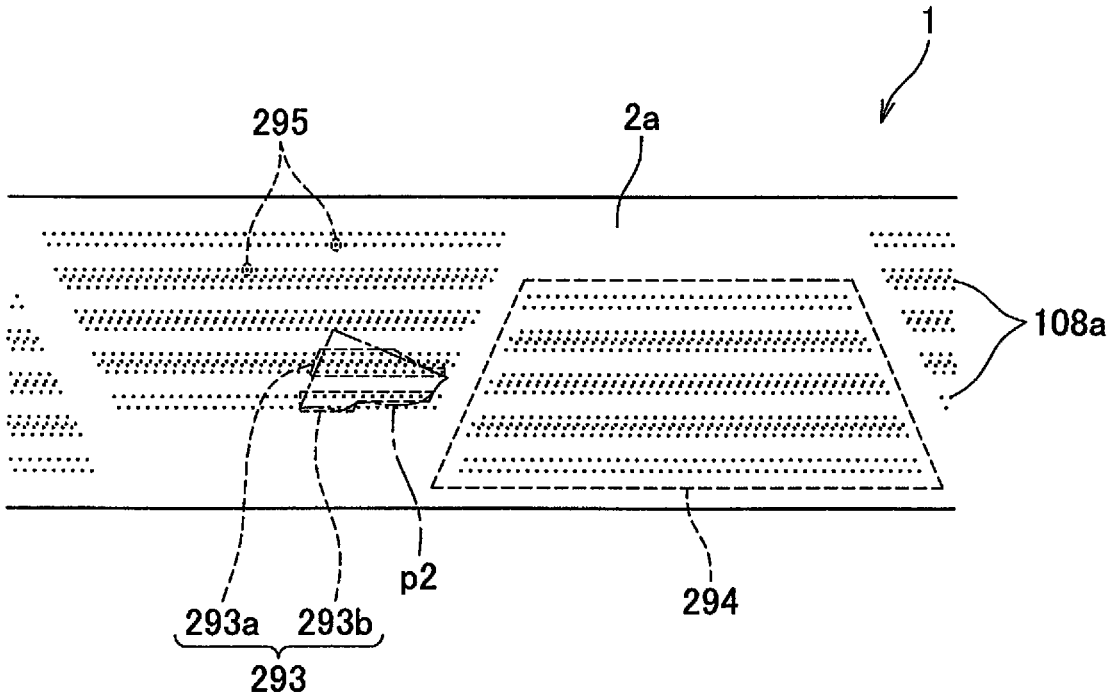
FIG. 13 relates to the second embodiment and is an enlarged view of the ink ejection surface, which shows the distribution of the ejection outlets failed to deposit ink on a media sheet.

In the meanwhile, when the shape of the distribution recognized by the image analysis unit 243 is identical with the shape of a trapezoidal region as in the case of the region 294 of FIG. 13, the image analysis unit 243 determines that no paper dust adheres. This is because, when, for example, the shape of the distribution of the ejection outlets 108*a* which failed to form dots is identical with the shape of the region 294, it is likely that no ink is ejected from the ejection outlets 108*a* from the start. That is to say, in the region 294, all of the ejection outlets 108*a* therein receive an ejection energy from a single actuator unit 21. When all of the ejection outlets 108*a* in this region failed to deposit ink on the media sheet P, it is likely that one of the actuators units 21 malfunctioned for some reason and hence all of the ejection outlets 108*a* in the region 294 failed to eject ink. On the other hand, it is highly improbable that paper dust adhered so that only the ejection outlets 108*a* in the same region 294 were precisely blocked.

In addition to the above, for example, when the recognized distribution is not a region in which two or more ejection outlets 108*a* are included in each closed region but a region in which only one ejection outlet 108*a* is included in each closed region as in the case of the region 295, the image analysis unit 243 determines that no paper dust adheres. This is because, when paper dust adheres, the dust is likely to prevent not single ejection outlet 108*a* but two or more ejection outlets 108*a* from ejecting ink. Therefore, when only one ejection outlet 108*a* is included in a single closed region, it is likely that no dot was formed because of a reason other than the adhesion of paper dust.

Figure 14:
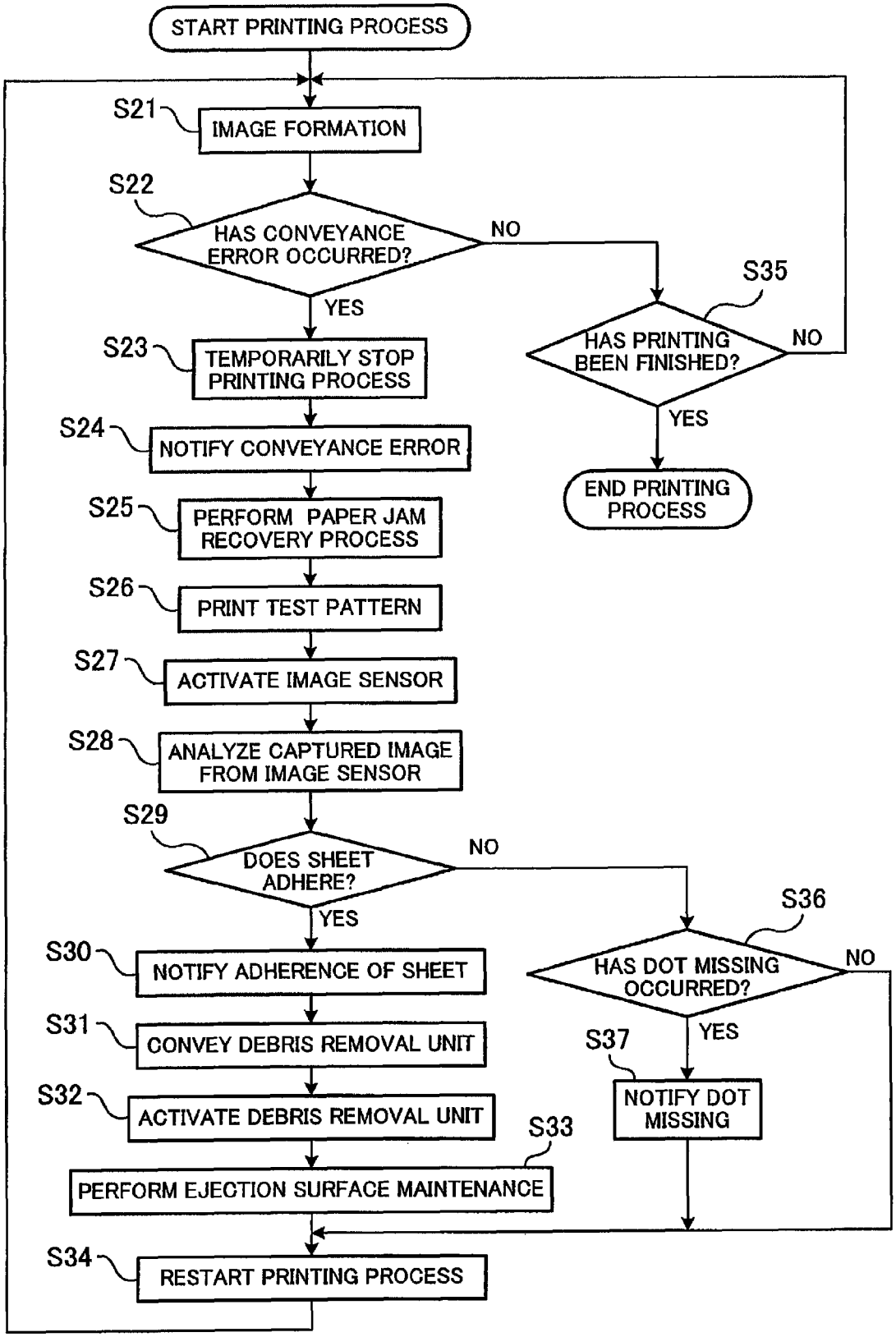
FIG. 14 is a flowchart of the processing steps that the control unit of the second embodiment executes during printing.

Referring to FIG. 14, the following describes the steps that the control unit 240 of the second embodiment executes during the printing process. As the printing process starts, the printing control unit 41 controls the inkjet heads 1 and the sheet conveyance mechanism 12 so that an image is formed on a media sheet P (S21). The control unit 240 then determines whether a conveyance error has occurred, based on the detection results of the conveyance sensors 161 (S22). If it is determined that no conveyance error has occurred, (S22, NO), the printing control unit 41 determines whether all jobs of the printing process have been finished (S35). If it is determined that all jobs of the printing process have been finished (S35, YES), the printing process ends. If it is determined that all jobs of the printing process have not been finished (S35, NO), the control unit 240 executes the steps from S21.

If it is determined in S22 that a conveyance error has occurred (S22, YES), the printing control unit 41 temporarily stops the printing process (S23). Then the conveyance error processing unit 242 causes the notifying unit 50 to notify that a conveyance error has occurred (S24). The conveyance error processing unit 242 then performs a paper jam recovery process (S25). The paper jam recovery process is carried out to resolve paper jam when a conveyance error has occurred due to the paper jam. An example of this process may be arranged such that a message which instructs the user to remove a jammed sheet is displayed by the notifying unit 50 and the printing process is halted until the paper jam is resolved. Alternatively, paper jam may be resolved by an arrangement which automatically resolves paper jam.

Subsequently, the conveyance error processing unit 242 sends a printing instruction to the printing control unit 41 so that a test pattern image is formed on a media sheet P (S26). Details of the test pattern image will be given later. The conveyance error processing unit 242 then activates the image sensor 251 and causes the image sensor 251 to capture an image of the test pattern image formed on the media sheet P (S27). Thereafter, the image analysis unit 243 of the conveyance error processing unit 242 analyzes the captured image data supplied from the image sensor 251 (S28). The image analysis unit 243 determines whether paper dust adheres to the ink ejection surface 2*a*, based on the captured image data supplied from the image sensor 251 (S29).

In other words, the image analysis unit 243 recognizes the distribution on the ink ejection surface 2*a* of the ejection outlets 108*a* which failed to form dots in the test pattern image, based on the pattern data stored in the nozzle pattern memory unit 45. The image analysis unit 243 determines that paper dust adheres, if the recognized distribution is identical with the region 293 of FIG. 13, for example (S29, YES).

On the other hand, the image analysis unit 243 determines that no paper dust adheres (S29, NO), when the recognized distribution is identical with the region 294 or region 295 of FIG. 13, for example. When it is determined that no paper dust adheres (S29, NO), the image analysis unit 243 further determines whether dot missing has occurred (S36). When all dots are successfully formed in the test pattern image, the image analysis unit 243 determines that dot missing has not occurred (S36, NO) and the control unit 240 executes the steps from S34. On the other hand, when, in the test pattern image, dots were not formed at the locations where they should have be, for example, when the distribution of the ejection outlets 108*a* which failed to form dots is identical with the region 294 or 295 of FIG. 13, the image analysis unit 243 determines that dot missing has occurred for a reason different from the adhesion of paper dust (S36, YES). In this case, the conveyance error processing unit 242 causes the notifying unit 50 to notify that dot missing has occurred (S37). Thereafter the steps are executed from S34.

In the meanwhile, if the image analysis unit 243 determines in S29 that paper dust adheres (S29, YES), the conveyance error processing unit 242 causes the notifying unit 50 to notify that paper dust adheres to the ink ejection surface 2*a* (S30). Then the debris removal control unit 44 causes the removal unit moving mechanism 180 to move the debris removal unit 170 to a position corresponding to the inkjet head 1 to which the paper dust adheres (S31). The debris removal control unit 44 then causes the debris removal unit 170 to execute the debris removal to remove the paper dust from the ink ejection surface 2*a* (S32). Furthermore, the conveyance error processing unit 242 causes the maintenance unit 140 to perform the ejection surface maintenance (S33). Thereafter the printing control unit 41 restarts the printing process (S34) and the control unit 240 executes the steps from S21.

In this way, in the second embodiment whether paper dust adheres to the ink ejection surface 2*a* is determined based on a captured image of a test pattern image formed on a media sheet P. In so doing, the distribution of the ejection outlets 108*a* which failed to form dots on the test pattern image is recognized based on the formation pattern of the ejection outlets 108*a* stored in the nozzle pattern memory unit 45, and whether paper dust adheres is determined with reference to this distribution. It is therefore possible to surely determine which is the case: ink did not deposit on the media sheet P because paper dust blocks the ejection outlets 108*a*; or simply the ejection outlets 108*a* failed to eject ink from the start. This helps to take proper action according to the situation, for example debris removal is performed and the adhesion of a fragment is notified when it is determined that paper dust adheres, or dot missing is notified when it is determined that ink did not deposit due to a reason different from the adhesion of paper dust.

While illustrative and presently preferred embodiments of the present invention have been described in detail herein, it is to be understood that the inventive concepts may be otherwise variously embodied and employed within the scope of the appended claims.

For example, even if the embodiments above assume that paper dust adheres to the ink ejection surface 2*a*, the present invention is applicable to the cases of other types of debris. That is to say, the present invention may be adapted so that the image analysis unit 43 and the image analysis unit 243 detect debris other than paper dust, which locates between the ink ejection surface 2*a* and the media contact surface 14*a* of the conveyor belt 14. Not limited to the cases where debris adheres to the ink ejection surface 2*a*, the present invention is applicable to the cases where the flight of ink is obstructed because debris locates between the ink ejection surface 2*a* and the opposing region below the ink ejection surface 2*a*.

In addition, although the embodiments above are arranged so that the debris removal, the ejection surface maintenance, and the notification of the adherence of paper dust are carried out when a shielding matter exists in the present invention, only one of or two of these operations may be carried out.

In addition, in the second embodiment, a test pattern image is formed on a media sheet P and whether paper dust adheres to the ink ejection surface 2*a* is determined based on a captured image of the test pattern image. Alternatively, the present invention may be adapted so that a test pattern image is formed not on a media sheet P but on the media contact surface 14*a* of the conveyor belt 14 and whether paper dust adheres to the ink ejection surface 2*a* is determined based on a captured image of such a test pattern image.

In addition, because of the inclusion of the image sensor 251 or the image sensor 351 of the second embodiment, the present invention may be embodied as a multifunction device having a scanner function of scanning an image formed on a media sheet P and a printer function of forming an image on a media sheet P. When the image sensor 351 is included, the image sensor 351 is able to perform both the function of the image sensor 151 of the first embodiment and the scanner function.

In addition, although in the embodiments above the ejection surface maintenance is carried out after the debris removal, a purging operation to eject redundant ink through the ejection outlets 108*a* may be performed in place of the ejection surface maintenance.

In addition, in the embodiments above, the notifying unit 50 notifies to which one of the inkjet heads 1*a* sheet adheres. In connection with this, the present invention may be adapted so that a light emitting unit is provided inside the main body in the vicinity of each inkjet head 1 and the light emitting unit corresponding to the inkjet head 1 to which a sheet adheres is arranged to emit light.

In the embodiments above, the image analysis unit 43 and the image analysis unit 243 specify the inkjet head 1 to which paper dust adheres and cause the notifying unit 50 to notify to which one of the inkjet heads 1 the paper dust adheres. Alternatively, the image analysis unit 43 or the like may recognize the position of the adhering paper dust in detail and cause the notifying unit 50 to notify the recognized detailed position.

In the second embodiment above, whether paper dust adheres is determined based on whether plural ejection outlets 108*a* are included in a closed region in the distribution of the ejection outlets 108*a* which failed to form dots on a test pattern image. Alternatively, whether paper dust adheres or not may be determined based on whether a predetermined number of ejection outlets 108*a* are included in a closed region. In addition to this, whether paper dust adheres or not may be determined based on whether the size of a closed region is larger than a predetermined size.

In addition to the above, when the so-called line scan head method is adopted as in the embodiments above wherein during the printing process the inkjet heads 1 do not move in the main scanning direction relative to a media sheet P, each inkjet head is required to be long or plural inkjet heads each being shorter than the width of a media sheet P must be disposed in the sub-scanning direction, in order to arrange the printing region to be as wide as a media sheet P in the sub-scanning direction. In these cases, a conveyance error is likely to result in the adherence of paper dust because the total size of the ink ejection surfaces is large. It is therefore considered that the present invention which makes it possible to properly determine the adherence of paper dust is suitable for the line scan head method. However, also in methods in which the head moves in the main scanning direction during the printing process, there is certainly a possibility that paper dust adheres on account of a conveyance error, and hence the present invention may be used for such methods.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising: an inkjet head having an ejection surface in which plural ejection outlets ejecting ink are formed;

a conveyor which has a placing member on which a recording medium is placed and which conveys the placing member to a position opposing the ejection surface;

a printing controller which causes the conveyor to convey the placing member to the opposing position and causes the inkjet head to eject the ink towards the opposing position;

an image sensor which captures an image of at least one of (i) a surface of the recording medium placed on the placing member, (ii) a surface of the placing member, and (iii) the ejection surface;

a blocking object determining unit which determines, based on the image captured by the image sensor, whether an object which blocks the flight of the ink exists between the ejection outlets and the opposing position so as to obstruct at least two neighboring ejection outlets among the ejection outlets; and a blocking object dealing unit which carries out a predetermined blocking object dealing operation when the blocking object determining unit determines that the object blocking the flight of the ink obstructs at least two neighboring ejection outlets among the ejection outlets.

2. The inkjet recording apparatus according to claim 1, further comprising a conveyance error detector which detects whether a conveyance error in conveying the recording medium has occurred in the vicinity of the opposing position, wherein, the image sensor captures an image of at least one of (i) a surface of the recording medium, (ii) a surface of the placing member, and (iii) the ejection surface, when the conveyance error detector detects that the conveyance error in conveying the recording medium has occurred in the vicinity of the opposing position.

3. The inkjet recording apparatus according to claim 1, wherein, the blocking object determining unit determines at which position the object blocking the flight of the ink exists, in a direction in parallel to the ejection surface.

4. The inkjet recording apparatus according to claim 3, wherein, the blocking object dealing unit includes a notifying unit which notifies a user of at which position the object blocking the flight of the ink exists in the direction in parallel to the ejection surface, and the blocking object dealing unit causes, as the predetermined blocking object dealing operation, the notifying unit to notify the user of at which position the object blocking the flight of the ink exists in the direction in parallel to the ejection surface.

5. The inkjet recording apparatus according to claim 3, wherein, the blocking object dealing unit includes a blocking object removal unit which performs a removal operation of removing the object blocking the flight of the ink, and the blocking object dealing unit causes, as the predetermined blocking object dealing operation, the blocking object removal unit to perform the removal operation in a range including the position in the direction in parallel to the ejection surface, which position is indicated by a result of determination by the blocking object determining unit.

6. The inkjet recording apparatus according to claim 5, wherein, the blocking object removal unit performs the removal operation in each of plural ranges on the ejection surface, and the blocking object dealing unit causes the blocking object removal unit to perform the removal operation in at least one of the plural ranges on the ejection surface, based on the result of determination by the blocking object determining unit.

7. The inkjet recording apparatus according to claim 1, further comprising an ink removal unit which removes ink on the ejection surface, wherein, the blocking object dealing unit causes the ink removal unit to remove the ink after the blocking object dealing unit causes the blocking object removal unit to perform the removal operation.

8. The inkjet recording apparatus according to claim 1, wherein, the image sensor captures an image of the ejection surface.

9. The inkjet recording apparatus according to claim 1, wherein, the image sensor captures an image of either the surface of the recording medium or the surface of the placing member, after the printing controller causes the inkjet head to eject the ink toward the opposing position.

10. The inkjet recording apparatus according to claim 9, wherein, the blocking object determining unit obtains distribution of the ejection outlets which fails to deposit ink onto the surface of the recording medium or the surface of the placing member, based on the image of the surface of the recording medium or the surface of the placing member captured by the image sensor, and the blocking object determining unit determines whether the object blocking the flight of the ink obstructs at least two neighboring ejection outlets among the ejection outlets, based on the obtained distribution of the ejection outlets.

11. The inkjet recording apparatus according to claim 10, wherein, the printing controller controls the inkjet head and the conveyor so that a predetermined test pattern image is formed on the surface of the recording medium or the surface of the placing member, and the blocking object determining unit obtains the distribution of the ejection outlets, based on the test pattern image indicated by the image of the surface of the recording medium or the surface of the placing member captured by the image sensor.

12. The inkjet recording apparatus according to claim 10, further comprising a pattern memory unit which stores pattern data regarding a formation pattern of the ejection outlets on the ejection surface, wherein, the blocking object determining unit obtains the distribution of the ejection outlets, based on the formation pattern indicated by the pattern data stored in the pattern memory unit and the image of the surface of the recording medium or the surface of the placing member captured by the image sensor.

13. The inkjet recording apparatus according to claim 1, wherein, the image sensor selectively capture an image of at least one of (i) the surface of the recording medium, (ii) the surface of the placing member, and (iii) the ejection surface.

14. The inkjet recording apparatus according to claim 1, wherein, when the printing controller causes the inkjet head to eject the ink onto the surface of the recording medium conveyed by the conveyor so that an image is formed on the recording medium, a position of the inkjet head is maintained relative to the recording medium in a direction which is orthogonal to a direction in which the conveyor conveys the recording medium and which is in parallel to the recording medium.

* * * * *